US006565238B1

(12) United States Patent
Pyrtle

(10) Patent No.: US 6,565,238 B1
(45) Date of Patent: May 20, 2003

(54) FLUORESCENT LIGHT FIXTURE WITH LATERAL BALLAST

(75) Inventor: Randy Pyrtle, Carthage, MO (US)

(73) Assignee: H. E. Williams, Inc., Carthage, MO (US)

( * ) Notice: Subject to any disclaimer, the term of this patent is extended or adjusted under 35 U.S.C. 154(b) by 0 days.

(21) Appl. No.: 09/603,739

(22) Filed: Jun. 23, 2000

(51) Int. Cl.[7] ..... F21V 29/00
(52) U.S. Cl. ..... 362/373; 362/294; 362/218
(58) Field of Search ..... 362/147, 218, 362/221, 222, 223, 260, 294, 364, 373

(56) References Cited

U.S. PATENT DOCUMENTS 4,414,616 A * 11/1983 Vos et al. ..... 362/223
4,750,096 A * 6/1988 Lim ..... 362/294
5,154,507 A * 10/1992 Collins ..... 362/218
5,253,152 A * 10/1993 Yang et al. ..... 362/221
6,174,074 B1 * 1/2001 Lahijani ..... 362/294

* cited by examiner

*Primary Examiner*—Y. My Quach-Lee
(74) *Attorney, Agent, or Firm*—Beirne, Maynard & Parsons, LLP

(57) ABSTRACT

A flourescent lighting fixture includes a secondary housing member for ballast laterally offset from and to one side of a primary housing member for flourescent bulbing. A bridge assembly extends between the housing members. A dead air enclosure may be positioned to one side of the bridge assembly and within the primary housing member for heat transfer abatement purposes. A metallic diverter panel may be provided within the primary housing member, for example, as one wall of the dead air enclosure. The housing members include a series of exteriorly protruding fin plate means for defusing heat generated by the flourescent bulbing throughout and across the exterior of the housing members and away from the interior of the ballast assembly.

5 Claims, 3 Drawing Sheets

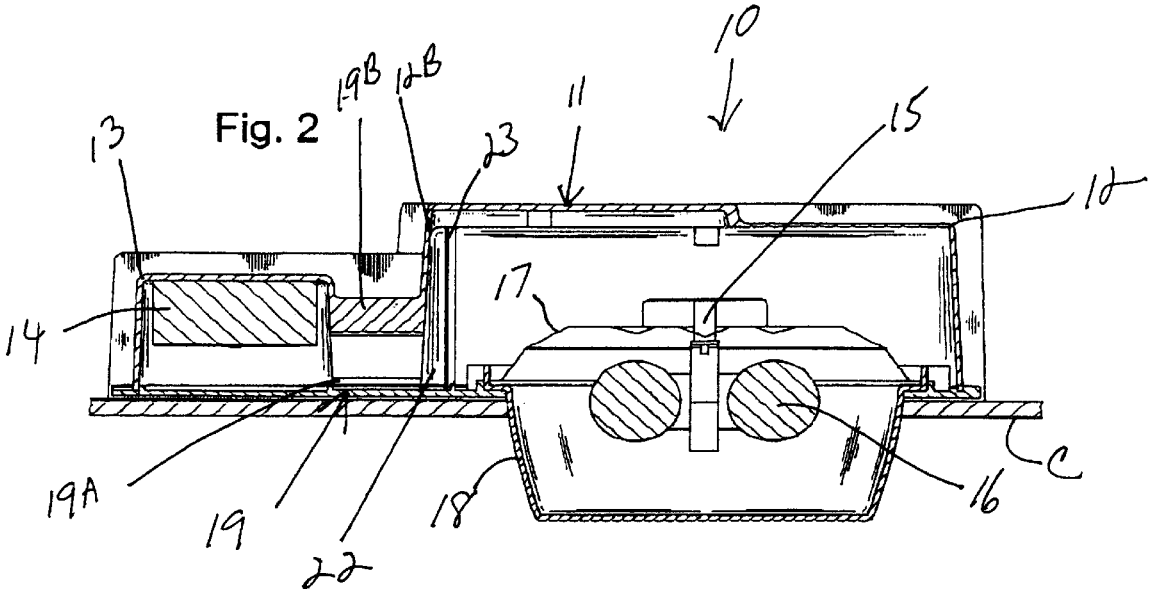
Fig. 2
Fig. 3
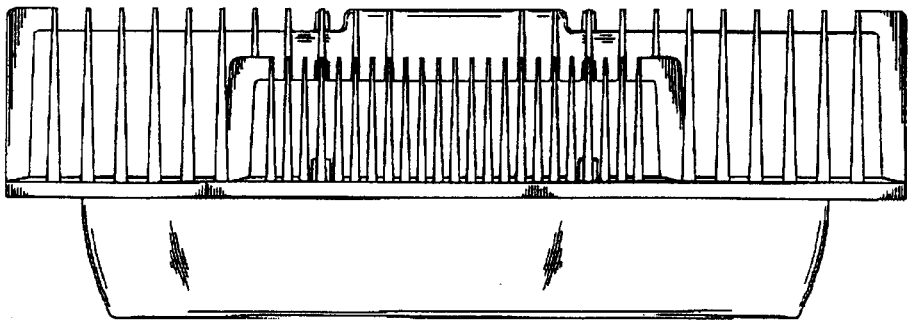

FLUORESCENT LIGHT FIXTURE WITH LATERAL BALLAST

BACKGROUND OF THE INVENTION (1) Field of the Invention

The present invention pertains to a flourescent lighting fixture in which the electronic ballast is provided in a housing member laterally offset to one side of the primary housing member receiving the flourescent bulbing and to other improvements for transferring heat generated within the fixture away from the ballast.

(2) Brief Description of the Prior Art

It is well known that flourescent lamps have a negative incremental impedance. Therefore, they cannot be connected directly to an AC voltage source: they require a ballast for stable operation.

There are several requirements for flourescent light ballasts. The ballasts should permit lamp voltages and currents which are sinusoidal with little distortion, so that RF-frequency or harmonic components are small. Otherwise, the lamp acts like an antenna and radiated noise is high. The output voltage to the ballast can be DC or low frequency ac voltage (50 Hz, 60 Hz or 400 Hz) and, if the lamp voltages and currents are at the same frequency of the input voltage, compliance with many specifications is not difficult to achieve. The harmonics of the output voltage and current drop off as frequency increases, so that long before reaching 160 KHz (the minimum frequency for which there is a limit on emissions), the harmonics are negligible. Low-frequency, low-distortion lamp voltage and current are therefore desirable. Conversely, high-frequency lamp voltage and current make it harder to comply with many utilization specifications since the first few harmonics of lamp voltage and current fall within the frequency range of many operational requirements.

Ballasts for use in conjunction with flourescent lighting assemblies must be capable of stabilizing the lamp current. Additionally, in the case of AC input power, high input power accommodation is a common requirement.

The ballast must be of a comparative small size and weight, particularly in part for smaller fixtures, located either mounted through sealings, provided in floor or furniture top assemblies or in small special application areas, such as in airplanes, boats and other vehicles.

The ballast must also provide lamp dimming capability which is a common requirement in many lamp applications. Some ballasts have a two-level dimming capability, full, bright and dim. It is sometimes desirable to be able to continuously dim the lamp as a function of a given control signal.

Prior art ballasts can be divided into categories: magnetic and electronic ballasts. In the past, so called magnetic ballasts were used extensively. Basically, a magnetic ballast consists of a large inductor (or autotransfer) placed between the ac source and the lamp. The impedance of inductor stabilizes the lamp. The lamp voltage and current are the same frequency of the input AC source. They are sinusoidal with very little high frequency components, so these ballasts have low radiated noise. As a matter of fact, most ballasts used in commercial vehicular applications as well as other applications are of this type. The input current is sinusoidal with little distortion and it has a lagging power factor due to the inductor. A capacitor at the input could be used to improve power factor. A disadvantage of this approach is large size and weight, since the line-frequency inductor used in the ballast is large. Additionally, another disadvantage is that continuous dimming is hard to implement. The present invention contemplates incorporation of magnetic ballast usage.

Another type of ballast used in conjunction with flourescent lighting is what is sometimes referred to as "High-Frequency Electronic Ballast". The art is very familiar with many examples of high-frequency and other electronic ballast that use switching power converters. In such a ballast system, a diode bridge rectifies an input AC voltage and a switching converter generates a square wave voltage at the switching frequency. A matching network is provided between the switching converter output and the gas discharge lamp. This matching network is usually a high-frequency resonant filter (usually an LCC filter) tuned to a frequency equal to, or close to, the switching frequency. It attenuates all the harmonics of the square wave voltage passing only the fundamental frequency. Furthermore, the matching network transforms the switching converter output characteristic from a voltage source into a current source, thus insuring stable lamp operation. A high input power factor can be obtained either by using a 2-stage converter consisting of a unity-power-factor shaper followed by a high-frequency inverter or by using a single stage converter, which usually operates in discontinuous conduction mode (DCM) at the input. Likewise, a typical prior art 2-state converter is such as shown on FIG. 2B describing U.S. Pat. No. 5,416,387, which also may be incorporated into the ballast used in the present flourescent light assembly.

An advantage of high-frequency ballast is reduced size and weight of magnetic elements, such as inductors and transformers due to the high-frequency operation. Another advantage is the ease of implementing continuous dimming capability by closing a current feed back control loop around the electronic ballast. The electron ballast has all the desirable properties except that the lamp voltage and current are at high-frequency, with a concomitant radiated noise problem.

As used herein, "ballast" also includes these and similar types of electric or electric ballast mechanisms.

In general minimal performance and quality assurance requirements for ballast of the electronic type should be as follows:

UL Listed Class P.

Sound Rated A.

Total harmonic distortion <=20% (<32% for 8 ft fixtures) with input current third harmonic not to exceed ANSI recommendation.

Ballast shall conform to ANSI specification C. 82.11-1993, if applicable. Minimum lamp operating frequency shall be 10 kHz.

Power factor >=0.85.

Enclosure size and wiring in same color as magnetic ballast (for retrofit applications).

Ballast factor to meet light output requirements. (Low ballast factor ballasts have low light output; high ballast factor ballasts have high light output.)

Maximum input wattage to meet energy requirements. Note that ballast factor and input wattage are linearly related.

Light regulation of +/−10% with +/−10% input voltage variation.

Lamp current crest factor <1.7.

Flicker 10% or less.

Specify start type to suit the project requirements. Instant start ballasts should be avoided for applications where lamps are turned on and off frequently such as would be the case for many occupancy-driven switching mechanisms.

Shall withstand line transients, per IEEE 587, Category A.

Shall meet FCC Rules and Regulations, Part 18C.

Circuit diagrams and lamp/ballast connections shall be displayed on all ballast cases.

Minimum ballast life shall be 50,000 hours.

Shall be ETL and UL listed.

Shall be CBM certified, if applicable.

Ballast shall have end of life sensing and shut down feature (for ballasts operating T5 or T4 lamps).

Flourescent lighting assemblies, like many other types of lighting assemblies, generate considerable heat during operation. Since the ballast and ballast housing sometimes have been located within the fixture assembly and the housing for the flourescent lighting bulbing, many fixtures have resulted in problems resulting from heat transfer into the ballast, resulting in loss or reduction of effective life of the very sensitive electronic components comprising the ballast assembly, and the like.

The present invention addresses the problems associated with housings for ballasts of the type generally described herein and incorporated within a flourescent lighting fixture housing.

SUMMARY OF THE INVENTION

The present invention is directed to a flourescent lighting fixture. A housing includes primary and secondary housing members. Means are provided, which are well known to those skilled in the art, for receipt of flourescent bulbing, which may be one of a number of different times and styles of commercially available flourescent bulbing.

The present invention is not particularly limited to any type of flourescent bulbing, and the fixture may include one or a plurality of any such bulbs. The drawings incorporated herein show a preferred embodiment of a fixture for receipt of a single flourescent bulb commercially available as the SYLVANNIA ICETRON LAMP. This lamp is rated for an unusually extended life of 100,000 hours, which is 5 to 8 times the typical service life of conventional flourescent and metal halide lamps.

The ballast system utilized for such lamps is believed to be particularly sensitive to heat generated by the lamp and, as such, this invention has particular application for lamp assemblies providing a flourescent lighting fixture for utilization of such types of high quality, long life flourescent lamps and associated ballast.

The invention includes a secondary ballast housing member within the housing and laterally offset from and to one side of the primary housing member. Electronic ballast means within the secondary ballast housing are provided for activating and controlling the flourescent bulbing. A bridge assembly is provided which extends between the primary and secondary housing members for lateral alignment of the housing member such that the ballast housing member still remains an integral part of the overall housing, yet is offset away from the primary housing member containing the lamp assembly.

The primary housing member may include a cover and a removable frame for the cover and the secondary housing member may also include a removable cover joined to the frame by the bridge assembly.

The bridge assembly may be provided, as shown, with the inclusion of first and second bridge members which are in vertical orientation, being provided at the top and bottommost portions of the housing members. Additionally, a dead air enclosure may be provided at one side of the primary housing member and in substantial horizontal alignment with the secondary housing member for further absorption of heat generated by the lighting fixture.

Additionally, a series of exteriorly protruding fin plate means may be provided on the housing for diffusing heat generated by the flourescent bulbing and may be utilized either with, or without, the offset laterally aligned housing members. A metallic diverter panel may be utilized in combination with the dead air enclosure and placed interiorly of the primary housing member for absorption of heat.

BRIEF DESCRIPTION OF THE DRAWINGS

FIG. 2 is a cross sectional view of the fixture shown in FIG. 1 in a ceiling application.

FIG. 3 is an exterior view of the fixture of FIG. 2 illustrating the fin plate means.

DESCRIPTION OF THE PREFERRED EMBODIMENT

Figure 1:
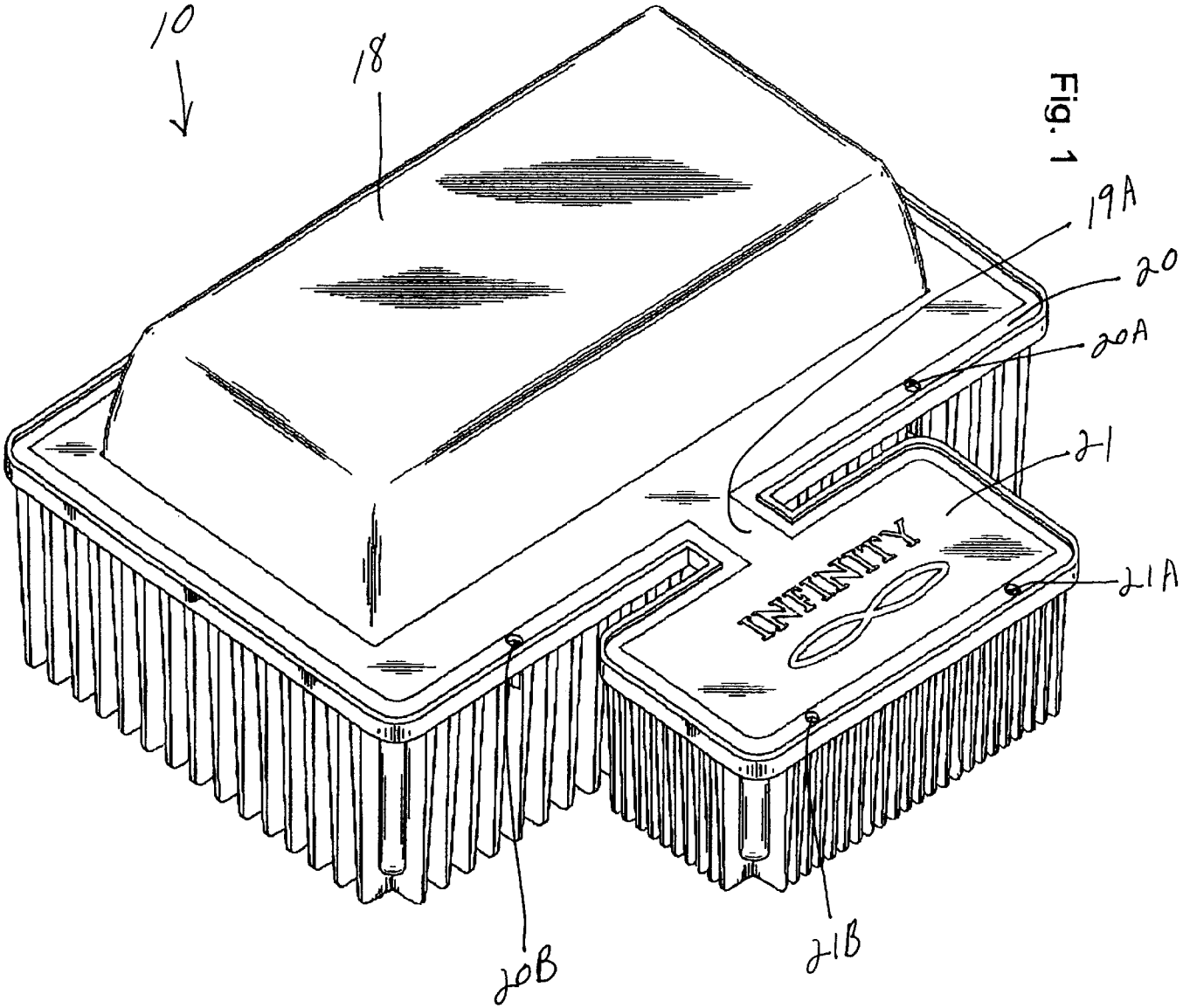
FIG. 1 is a prospective view of the flourescent lighting fixture of the present invention prior to it being inserted into place in, for example, a sealing operation.

Now, with first reference to FIG. 1, a lighting fixture 10 is illustrated. The fixture 10 includes a cover 18 which is inserted within a removable frame 20 by means of screws 20A and 20B being inserted within a primary housing member 12 (FIG. 2). A first bridge member 19A is shown for lateral alignment of a companionly defined removable cover 21 secured by light screws 21A and 21B to a secondary housing member 13 (FIG. 2).

Now referring to FIG. 2, the fixture 10 includes a housing 11 having a primary housing member 12 including means 15 for receipt of flourescent bulbing 16. A conventional reflector panel 17 is provided interiorly of the primary housing member 12 for directing light generated by the bulbing 16 exteriorly and away from the fixture 10 through the cover 18. As shown, the fixture 10 is mounted interiorly within a ceiling C, in conventional fashion, with the cover 18 protruding downwardly therefrom.

The housing 11 also includes a secondary housing member 13 which houses the ballast 14, as earlier described. Electrical conduits (not shown) extend between the ballast 14 and the bulbing 16 for activation and controlling of the bulbing 16. Likewise, the ballast 14 communicates to a source of AC or DC power (not shown) by like conduits and cables (not shown).

The secondary housing member 13 is laterally offset from the primary housing member 12 by means of a bridge assembly 19 which includes a first bridge member 19A and a second, or somewhat thicker, bridge member 19B, each extending from one side wall 12B of the primary housing member 12. A metallic diverting panel 23 is provided within the primary housing member 12 on one side thereof, i.e., that side directed toward the secondary housing member 13 and the ballast 14. This metallic diverter panel will, by its construction, absorb some of the heat reflected from the bulbing 16 and within the interior of the primary housing member 12 and will act as a heat defusor. Likewise, between the diverting panel 23 and the side wall 12B is a dead air enclosure 22 which also acts for purposes of heat absorption and which contributes to the, reduction of heat from the bulbing 16 through the reflector panel 17, the primary housing member 12 and the diverter panel 23 and resists transfer of such heat into the secondary housing member 13 and the ballast 14. In effect, the panel 23 acts as one wall of the dead air enclosure 22, but may be provided in a form in which it is substantially independent but substantially parallel to such a wall.

Figure 4:
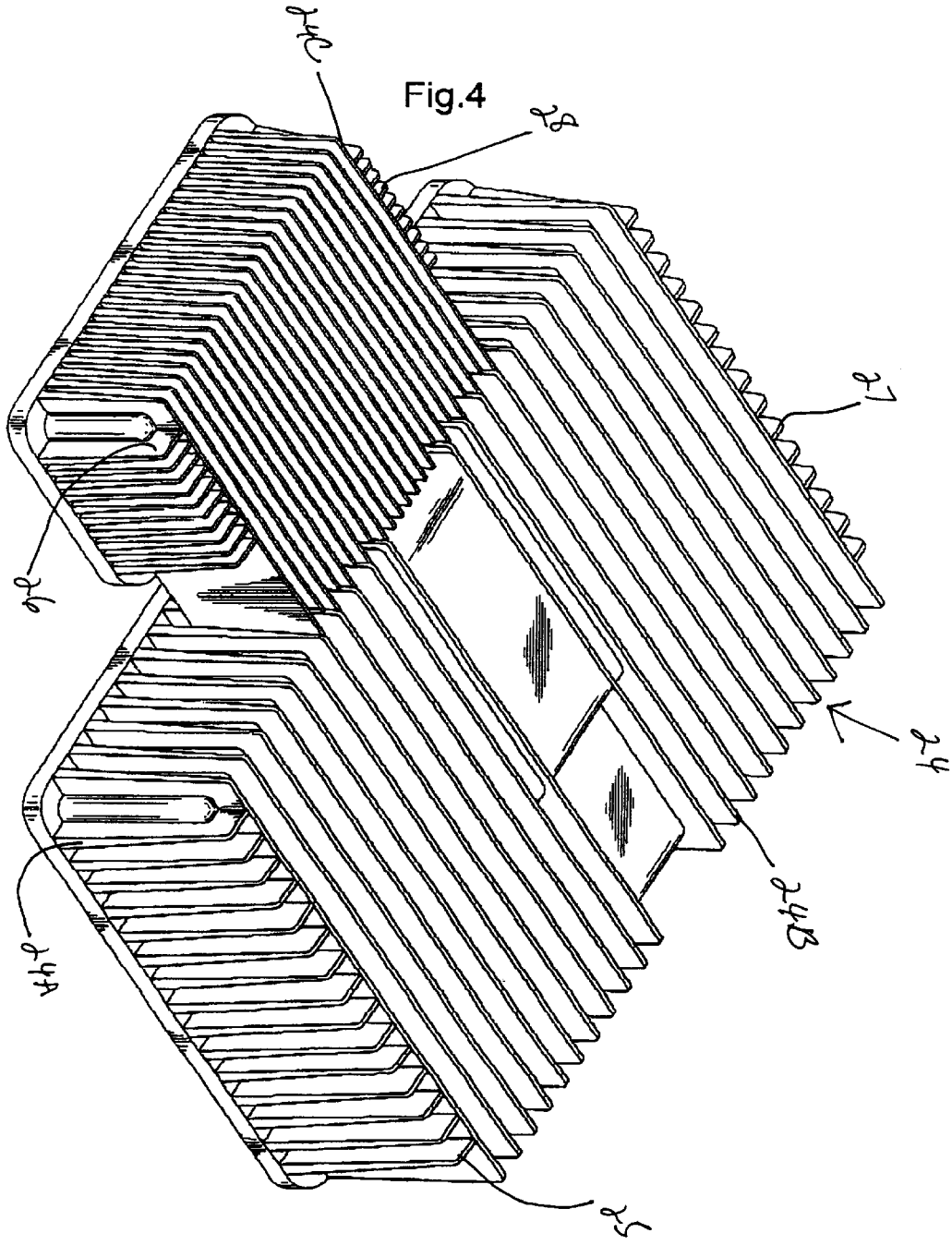
FIG. 4 is a view similar to that of FIG. 3, but prospectively viewing the fin plate configuration, looking toward the bottom of the housing.

Now referring to FIG. 4, a series of fin plates 24 are provided and defined on the exterior of the primary and secondary housing members 12 and 13. The primary fins 24B are provided in a number of rows across the primary housing member 12. The primary fins 24B are provided in an inverted "V"-shaped configuration whereby the enlarged portion 24A of the configuration is closest to the lower or bottom face of the primary and secondary housings 12 and 13. Similar fin elements 25 and 27 are configured at each opposing end of the primary housing member 12. Similar terminal fin elements 26 and 28 are provided at each end of the outer secondary housing member 13. The secondary fins 24C are provided in inter aligning orientation relative to adjoining primary fins 24B for contacting relationship therewith for further defusion of heat within the housing members.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly modifications are contemplated which can be made without departing from the spirit of the described invention.

What is claimed and desired to be secured by Letters Patent is:

1. A flourescent lighting fixture, comprising:

(a) a housing including a primary housing member;

(b) means for receipt of flourescent bulbing within said primary housing member;

(c) a secondary ballast housing member within said housing and laterally offset from and to one side of said primary housing member;

(d) ballast means within said secondary ballast housing member for activating and controlling said fluorescent bulbing;

(e) a bridge assembly extending between the primary and secondary housing members; and (f) a dead air enclosure within said primary housing member and laterally offset to one side of said bridge assembly.

2. A flourescent lighting fixture; comprising:

(a) a housing including a primary housing member;

(b) means for receipt of fluorescent bulbing within said primary housing member;

(c) a secondary ballast housing member within said housing and laterally offset and to one side of said primary housing member;

(d) ballast means within said secondary ballast housing member for activating and controlling said fluorescent bulbing; and (e) a bridge assembly extending between the primary and secondary housing members, said primary housing member further including a cover and a removable frame for said cover, said secondary housing member further including a removable cover joined to said frame by said bridge assembly.

3. A flourescent lighting fixture; comprising:

(a) a housing including a primary housing member;

(b) means for receipt of fluorescent bulbing within said primary housing member;

(c) a secondary ballast housing member within said housing and laterally offset from and to one side of said primary housing member;

(d) ballast means within said secondary ballast housing member for activating and controlling said fluorescent bulbing; and (e) a dead-air enclosure at one side of said primary housing member and in substantial horizontal alignment with said secondary housing member.

4. The lighting fixture of claim 3; said dead-air enclosure including a metallic diverter panel interior of said primary housing member for absorption of heat generated by said flourescent bulbing.

5. A fluorescent lighting fixture, comprising:

(a) a housing including a primary housing member;

(b) means for receipt of fluorescent bulbing within said primary housing member;

(c) a secondary ballast housing member within said housing and laterally offset and to one side of said primary housing member;

(d) ballast means within said secondary ballast housing member for activating and controlling said fluorescent bulbing; and (e) said primary and secondary housing members including a series of exteriorally protruding fin plate means for deffusing heat generated by said fluorescent bulbing.

* * * * *